US005238043A

United States Patent [19]

Woodring et al.

[11] Patent Number: 5,238,043

[45] Date of Patent: Aug. 24, 1993

[54] APPARATUS FOR ACCURATE ADJUSTMENT OF THE SLATS IN A VENETIAN BLIND

[75] Inventors: Cooper C. Woodring, Plandome, N.Y.; Ira Gaber, West Norwalk, Conn.

[73] Assignee: Better Mousetraps, Inc.

[21] Appl. No.: 830,193

[22] Filed: Jan. 31, 1992

[51] Int. Cl.[5] ..... E06B 9/26

[52] U.S. Cl. ..... 160/175; 160/176.1

[58] Field of Search ..... 160/176.1, 177, 174, 160/178.1, 175, 276, 300, 302

[56] References Cited

U.S. PATENT DOCUMENTS

| | | | |
|---|---|---|---|
| 909,927 | 1/1909 | McKnight | 160/175 |
| 1,097,812 | 5/1914 | Malmgren . | |
| 1,324,421 | 12/1919 | Biasucci | 160/300 |
| 1,845,870 | 2/1932 | Fowler et al. . | |
| 2,206,796 | 7/1940 | Williams . | |
| 2,529,229 | 11/1950 | Sherwood . | |
| 2,568,324 | 2/1947 | Den Dulk . | |
| 2,849,062 | 5/1957 | Bonsteel . | |
| 2,914,122 | 11/1959 | Pinto . | |
| 3,921,695 | 11/1975 | Debs | 160/176.1 |
| 5,038,843 | 8/1991 | Sommerfeld | 160/175 X |

FOREIGN PATENT DOCUMENTS

| | | | |
|---|---|---|---|
| 138052 | 2/1949 | Australia | 160/175 |
| 184662 | 7/1963 | Sweden | 160/175 |

*Primary Examiner*—Blair M. Johnson

*Attorney, Agent, or Firm*—George P. Hoare, Jr., Shea & Gould

[57] ABSTRACT

A venetian blind includes a plurality of slats, rotating means for rotating the slats from a first closed setting through a plurality of open settings to a second closed setting, and indicating means for indicating when the rotating means has rotated the slats to one of a plurality of predetermined desired settings, including at least one open setting. In preferred embodiments of the invention, the means for indicating includes a cam that rotates as the tilt rod is rotated. The cam has a substantially annular perimeter with a number of detents at predetermined locations corresponding to the predetermined desired settings of the slats. A spring clip is biased toward the perimeter of the cam such that a portion of the spring clip travels along the perimeter of the cam when the cam is rotated and engages a detent when it becomes aligned with the detent. The engagement of the spring clip with the detent will provide a visual indication to a user that a predetermined desired setting of the slats has been achieved since the slats will jump to the desired setting as the user rotates the slats to a position that is close to the desired setting. When a desired setting has been achieved further rotation of the slats will be impeded to provide a tactile indication to the user that the desired setting has been achieved.

13 Claims, 11 Drawing Sheets

APPARATUS FOR ACCURATE ADJUSTMENT OF THE SLATS IN A VENETIAN BLIND

FIELD OF THE INVENTION

This invention relates to venetian blinds, and, more particularly, to a device for facilitating the accurate adjustment of the slats of a venetian blind to one of several predetermined settings.

BACKGROUND OF THE INVENTION

Venetian blinds are popular window treatments and can be found in homes and offices throughout the world. A typical venetian blind includes a number of elongated slats suspended from a head rail that is mounted at the top of a window. The orientation of the slats can be adjusted to vary the amount of light that can pass into the room. For example, when the slats are substantially parallel to the window they are said to be closed and little light will be able to pass through the blind. When the slats are adjusted to be perpendicular to the window they are open and more light will be able to pass into the room.

Although the slats of a venetian blind can be adjusted to an infinite number of different settings, each representing a different angle between the slats and the window, research has demonstrated that most venetian blind users prefer to adjust their slats to one of a relatively limited number of settings. For example, popular settings include the closed setting with the slats parallel to the window, the "full open" setting with the slats perpendicular to the window, and a position where the slats are at a 45° angle with respect to the window.

It is difficult for a user to determine visually when the slats are set at the precise orientation desired. Furthermore, it is difficult to adjust the slats on a number of venetian blinds in the same proximity such that the slats on all of the blinds are set at precisely the same orientation, which is an aesthetically desirable result. Accordingly, venetian blind users waste time attempting to fine tune the adjustment of the slats to a desired setting and are often unable to precisely align the slats on adjacent blinds.

SUMMARY OF THE INVENTION

The venetian blind of the present invention includes a slat angle selector which overcomes the deficiencies in the art by allowing a user to quickly adjust the slats to one of a number of predetermined desired settings. The venetian blind of the invention includes a plurality of slats, rotating means for rotating the slats from a first closed setting through a plurality of open settings to a second closed setting, and indicating means for indicating when the rotating means has rotated the slats to one of a plurality of predetermined desired settings, including at least one open setting.

In preferred embodiments of the invention, the means for rotating the slats includes an elongated tilt rod, a ladder suspended from the tilt rod, the ladder having a plurality of vertically spaced rungs and two substantially vertical rails connecting the rungs to the tilt rod, and a means for rotating the tilt rod. Each of the slats is supported by a rung in the ladder, and the means for rotating the tilt rod causes the slats to rotate.

In one embodiment, the means for indicating includes a cam that rotates as the tilt rod is rotated. The cam has a substantially annular perimeter with a number of detents at predetermined locations corresponding to the predetermined desired settings of the slats. A spring clip is biased toward the perimeter of the cam such that a portion of the spring clip travels along the perimeter of the cam when the cam is rotated and engages a detent when it becomes aligned with the detent. The engagement of the spring clip with the detent will provide a visual indication to a user that a predetermined setting of the slats has been achieved and will impede further rotation of the cam, thereby impeding rotation of the tilt rod.

In another embodiment, the means for indicating comprises a cam having a resilient protrusion that engages detents formed in a housing that is positioned close to the outer perimeter of the cam. In the disclosed embodiments the cam is either substantially cylindrical or is finger shaped.

In yet another embodiment, the means for indicating comprises a cam and two arms pivotally secured to a housing, with the arms biased toward the cam. Each arm includes a protrusion that can engage a detent in the cam.

The means for rotating the tilt rod includes an idler gear positioned to cause the tilt rod to rotate when the idler gear is rotated, and a worm gear positioned to cause rotation of the idler gear when the worm gear is rotated. The idler gear can be integral with the cam. A wand is connected to the worm gear and is used to cause the worm gear to rotate.

In operation, the means for indicating when the slats have been rotated to a predetermined desired setting will permit a user to be able to quickly and accurately adjust the slats of the blind to a desired setting. In an illustrative embodiment, the indicating means will cause the slats to jump into a desired setting when a user rotates the slats to a point that is close to the desired setting. Once the slats are in the desired setting, the force needed to rotate the slats will be greater than the forced required to rotate the slats before the slats reach a desired setting, thereby providing a tactile indication to the user that the desired setting has been reached. The invention eliminates the need for a user to guess when the slats have been adjusted to a desired setting.

DETAILED DESCRIPTION OF THE PREFERRED EMBODIMENTS

Figure 1:
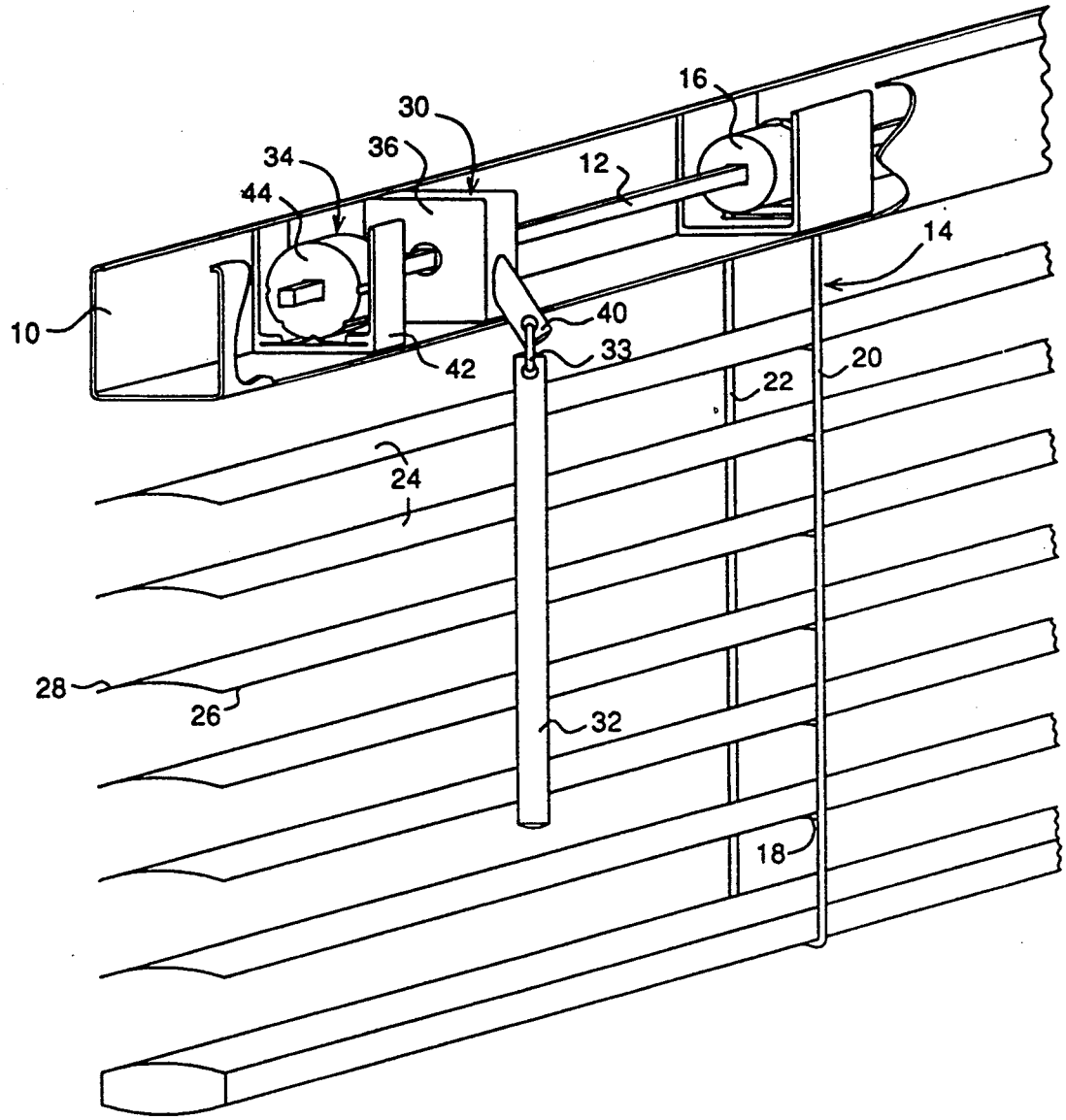
FIG. 1 is a sectional perspective view of a venetian blind according to a preferred embodiment of the invention.

An illustrative embodiment of the invention is shown in FIGS. 1-5, and includes a head rail 10 (see FIG. 1) that is mounted to the window by standard brackets (not shown). An elongated tilt rod 12 is rotatably mounted within head rail 10. A ladder 14 is suspended from a ladder drum 16 which is positioned to rotate with tilt rod 12. Ladder 14 includes a number of rungs 18, an interior rail 20, and an exterior rail 22. The rails 20, 22 are each attached to ladder drum 16. A second similar ladder drum and ladder are connected to tilt rod 12 at a section of the blind not shown in FIG. 1.

A number of slats 24 are each supported by one rung 18 of ladder 14 such that an interior edge 26 of each slat is positioned adjacent to interior rail 20 and an exterior edge 28 of each slat is positioned adjacent to exterior rail 22.

A tilter 30 is seated within head rail 10 and surrounds tilt rod 12. Tilter 30 includes a housing 36 through which extends a worm gear 40. A wand 32 is connected to worm gear 40 by a clip 33.

A tilt angle selector 34 is also seated within head rail 10 and surrounds tilt rod 12. Tilt angle selector 34 includes a housing 42 and a detent cam 44.

Figure 2:
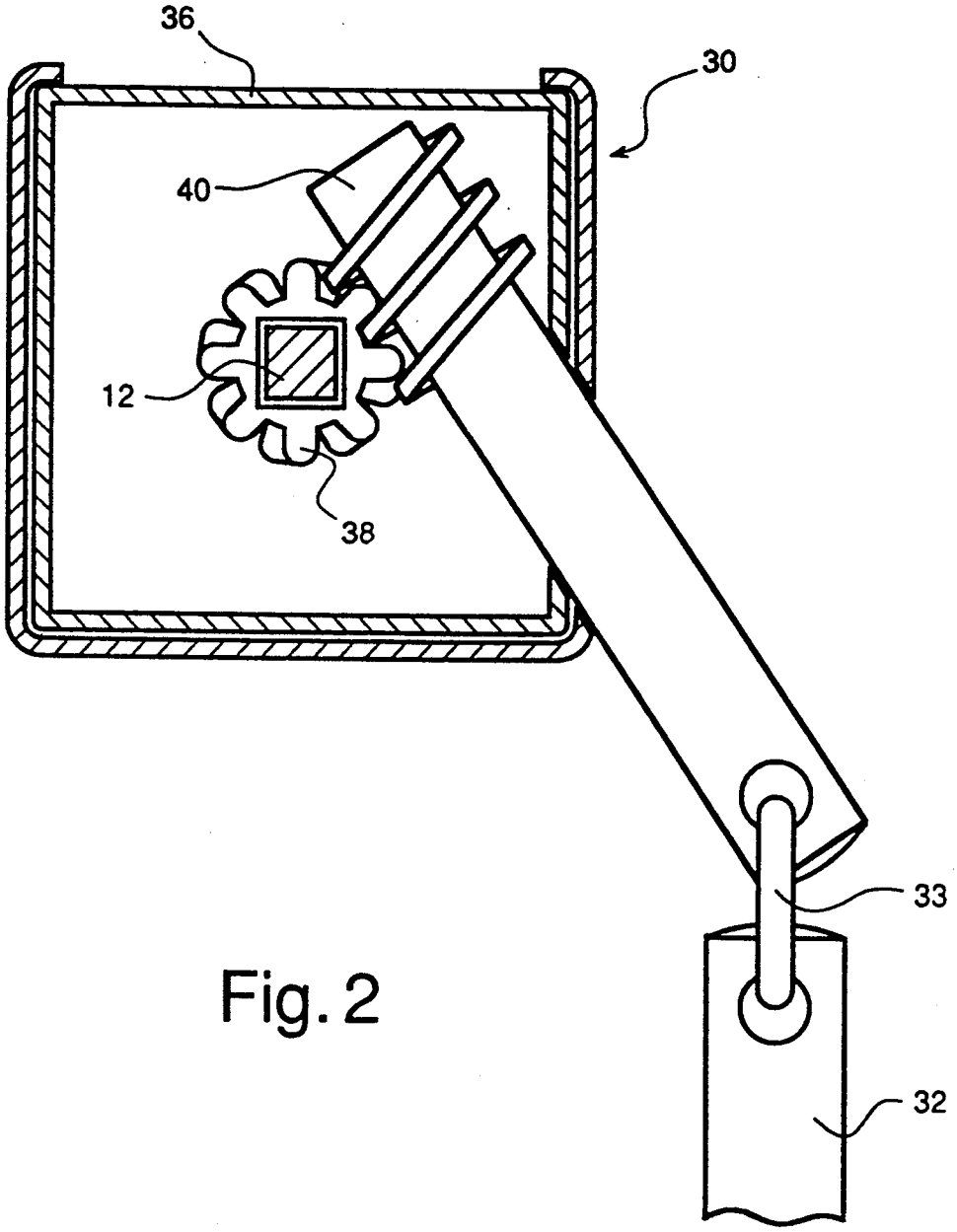
FIG. 2 is a cross-sectional end view of a tilt gear mechanism shown in FIG. 1.

Tilter 30 is shown in greater detail in FIG. 2 and includes an idler gear 38 which surrounds tilt rod 12 such that rotation of idler gear 38 causes tilt rod 12 to rotate. A worm gear 40 is connected to wand 32 by clip 33 and is positioned such that when worm gear 40 is rotated by rotation of wand 32, idler gear 38 will also rotate.

Figure 3:
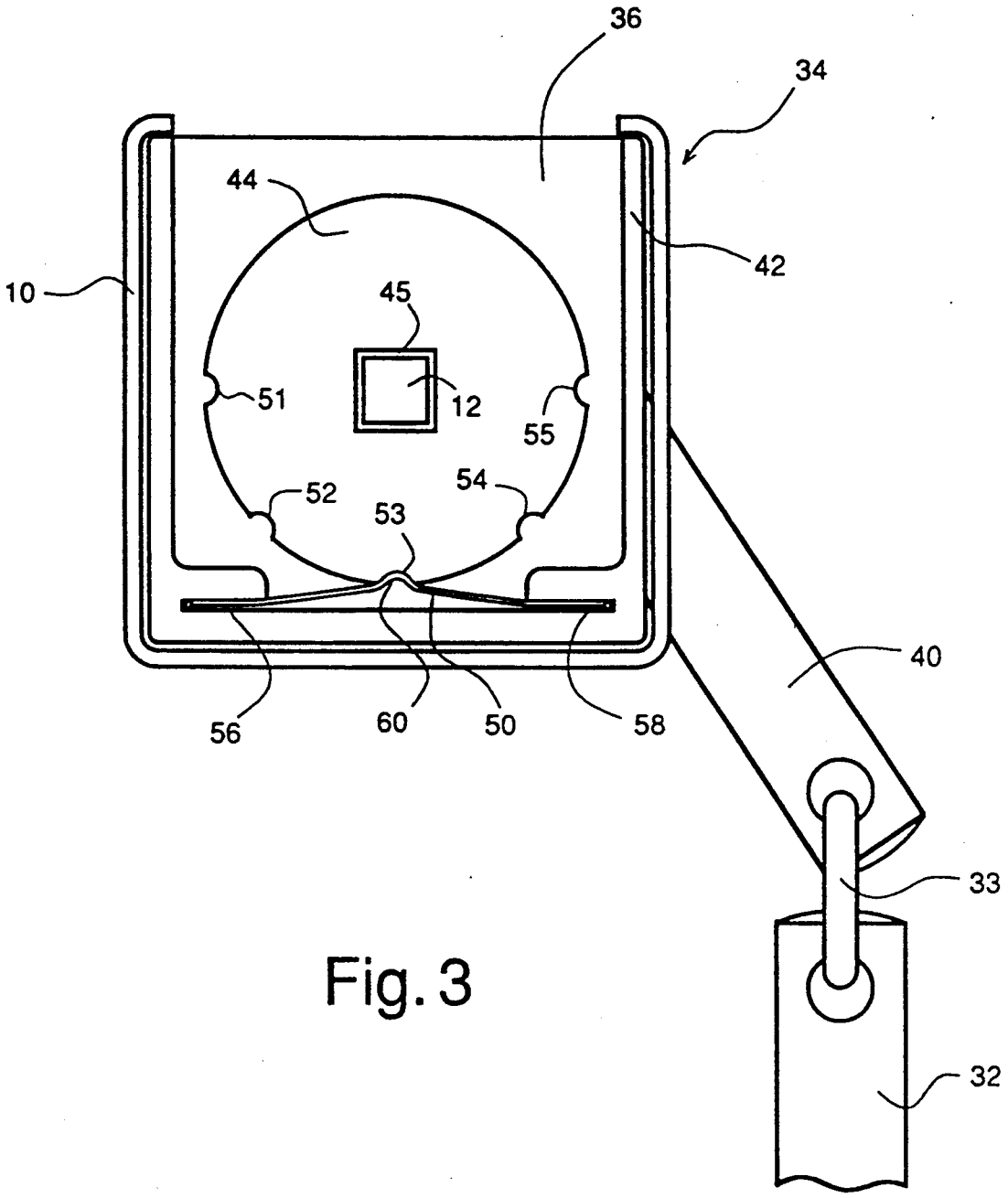
FIG. 3 is a cross-sectional end view of a tilt angle selector shown in FIG. 1.
Figure 4:
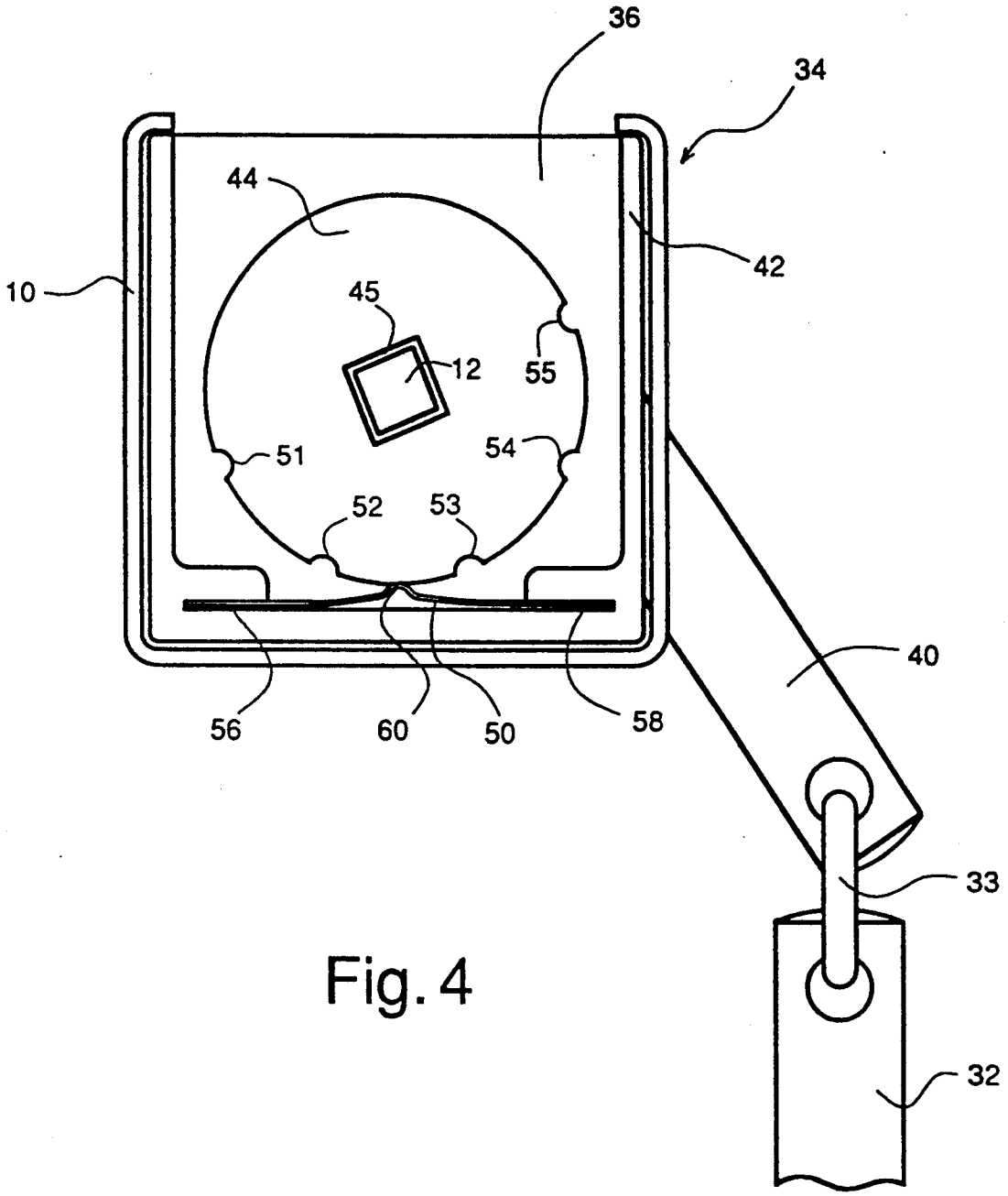
FIG. 4 is a second cross-sectional end view of the tilt angle selector shown in FIG. 1.

Tilt angle selector 34 is shown in greater detail in FIGS. 3 and 4. Detent cam 44 includes a rectangular aperture 45 through which tilt rod 12 passes such that detent cam 44 will rotate as tilt rod 12 is rotated. The outer perimeter of detent cam 44 is substantially annular and includes five detents 51-55, at evenly spaced locations along a 180° section of the perimeter of detent cam 44. A spring clip 50 is positioned within two recesses 56, 58 formed in housing 42, and is biased toward detent cam 44 such that a rounded tip 60 of spring clip 50 contacts the perimeter of detent cam 44.

Figure 5:
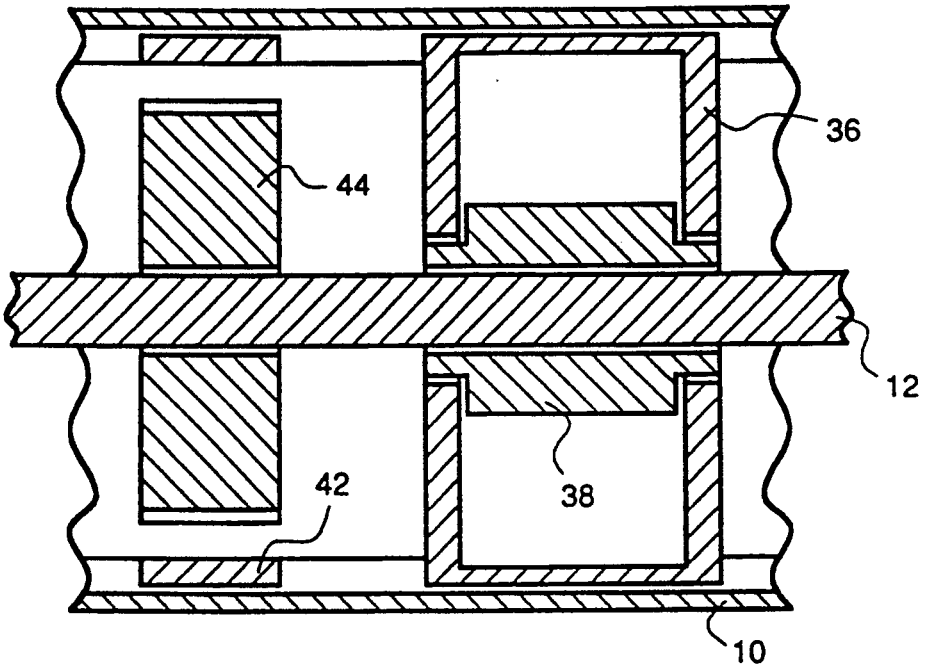
FIG. 5 is a cross-sectional longitudinal view of the tilt gear mechanism and tilt angle selector shown in FIG. 1.

FIG. 5 is a longitudinal cross-sectional view of a section of the venetian blind shown in FIG. 1 and shows tilt rod 12 surrounded by both idler gear 38 and detent cam 44. Housing 42 of tilt angle selector 34 and housing 36 of tilter 30 are also shown in FIG. 5.

When a user of the venetian blind shown in FIGS. 1-5 wishes to adjust the orientation of slats 24, wand 32 is rotated causing worm gear 40 to rotate idler gear 38. (See FIGS. 1-2) As idler gear 38 rotates, tilt rod 12 will rotate, causing ladder drum 16 to rotate. As ladder drum 16 rotates, either interior rail 20 or exterior rail 22 will be raised, while the other rail is lowered, depending on the direction of rotation of wand 32. In other words, when wand 32 is rotated in one direction interior rail 20 will be raised and exterior rail 22 will be lowered. When wand 32 is rotated in the opposite direction, interior rail 20 will be lowered while the exterior rail 22 is raised. The raising and lowering of the rails will change the angle of orientation of rungs 18 and, therefore, the angle of orientation of slats 24 with respect to the window will be adjusted. In this manner, slats 24 can be rotated from a first closed position with exterior rail 22 raised to its highest position and interior rail 20 at its lowest position to a second closed position with exterior rail 22 in its lowest position and interior rail 20 in its highest position. Between these two closed positions are an infinite number of settings which can be selected by rotation of wand 32. As is explained below, tilt angle selector 34 will facilitate the selection of one of five predetermined settings.

Referring to FIG. 3, when tilt rod 12 is rotated to adjust the orientation of slats 24, detent cam 44 will also rotate due to the contact between tilt rod 12 and detent cam 44. The periphery of detent cam 44, which is caused to rotate by tilt rod 12, will "travel" in relationship to the non-rotating tip 60 of spring clip 50, which is biased against detent cam 44. When one of detents 51-55 becomes aligned with tip 60 of spring clip 50, tip 60 will engage the detent. FIG. 3 shows tip 60 engaged with detent 53. The engagement of tip 60 with a detent will impede the rotation of detent cam 44 and, therefore, will impede the rotation of tilt rod 12. The user of the venetian blind will feel this engagement of tip 60 in a detent, as it will become more difficult to rotate wand 32. If the user continues to apply a rotating force to wand 32, tip 60 will disengage from detent 53 and will continue to travel along the perimeter of detent cam 44. FIG. 4 shows tip 60 at an intermediate location between cams 52 and 53. When tip 60 reaches detent 52, it will again become engaged and the user will once again feel increased resistance as he turns wand 32.

Therefore, as the user rotates the wand 32, cam 44 will rotate causing one detent to travel away from tip 60 of spring clip 50 and another detent to travel toward tip 60 of spring clip 50, with the user feeling a resistance to the rotation of wand 32 as each detent is engaged. The orientation of detent cam 44 and the placement of detents 51-55 are selected so that detents 51-55 are engaged by spring clip 50 when slats 24 are in predetermined desired settings. For example, when wand 32 is rotated such that detent 55 is engaged with tip 60 of spring clip 50, slats 24 are in a first closed position with the exterior edge 28 of each slat in its highest position and the interior edge 26 of each slat in its lowest position. As wand 32 is rotated, the perimeter of detent cam 44 will travel until detent 54 engages the tip 60 of spring clip 50. In this position, slats 24 will form approximately a 45° angle with respect to the window, with the exterior edges 28 of the slats higher than interior edges 26. When wand 32 is rotated until tip 60 is engaged with cam 53, slats 24 will be in the full open position, with the slats approximately perpendicular to the window, and exterior edges 28 will be at the same height as interior edges 26. When tip 60 is engaged with cam 52, the slats 24 will again be at a 45° angle relative to the window, this time with exterior edges 28 below interior edges 26. Finally, when tip 60 is engaged with cam 51, slats 24 are in a second closed position, with interior edges 26 of each slat in their highest position.

Accordingly, a user can quickly and easily find one of the five predetermined settings represented by the five detents 51-55 by rotating wand 32 until tip 60 becomes engaged with a detent. The user will become aware that tip 60 has engaged a detent by both visual and tactile stimulus. As the slats approach the desired setting and tip 60 contacts the closest edge of a detent, the biasing force of the spring clip will cause the detent cam to rotate until tip 60 is fully engaged with the detent. This rotation of the detent cam will cause the slats to "jump" to the desired setting, thus providing a visual indication to the user that the predetermined setting has been achieved. Furthermore, if a user continues to rotate wand 32 after a desired setting has been achieved, increased force will be necessary to disengage tip 60 from a detent. The user will therefore feel an increased resistance to the rotation of wand 32, providing a further indication that a desired setting has been achieved.

The venetian blind illustrated in FIGS. 1-5 also includes a standard pull cord system that is not shown in the figures, which is used to raise and lower slats 24. The appropriate materials to be selected for the various parts of the venetian blind of the invention will be well known to those skilled in the art. For example, head rail 10 can be made of a metal such as aluminum or steel, or can be formed of a suitable plastic. Slats 24 can be made of a metal such as aluminum or steel, or can be made of a suitable plastic, wood or other suitable material. Additionally slats 24 can be narrow in width (micro), medium width (mini), or conventional width (one inch) or wider. The gears and detent cam are preferably formed of plastic. The ladders are preferably formed of a strong lightweight twine.

Figure 6A:
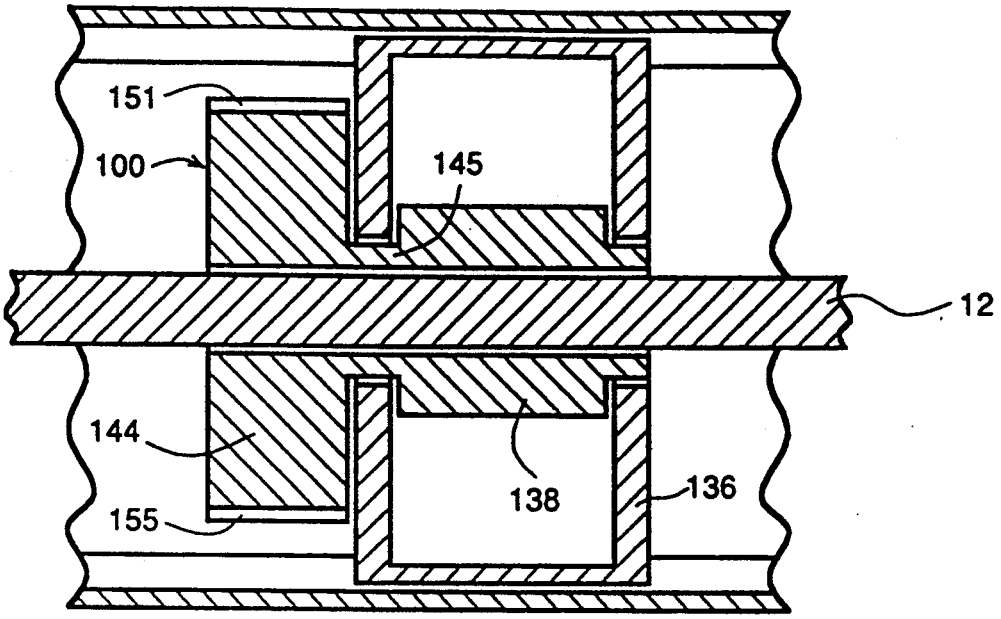
FIGS. 6*a* and 6*b* are cross-sectional longitudinal views of a tilt gear mechanism and tilt angle selector according to other embodiments of the invention.

Another embodiment of the invention is shown in FIG. 6*a*, and utilizes an integrated unit 100 that includes a detent cam 144 connected by a drive section 145 to an idler gear 138. Detent cam 144 includes five detents, two of which (151 and 155) are shown in FIG. 6*a*. Integrated unit 100 surrounds tilt rod 12 and a housing 136 surrounds idler gear 138. A spring clip (not shown) is positioned to be biased against detent cam 144.

The embodiment of FIG. 6*a* works in a manner that is generally similar to the embodiment illustrated in FIGS. 1-5 except that detent cam 144 is integral with idler gear 138 and, therefore, detent cam 144 is driven directly by the same worm gear (not shown in FIG. 6*a*) that drives idler gear 138. Detent cam 144 and idler gear 138 are otherwise similar to detent cam 44 and idler gear 38 shown in FIGS. 2-4. The embodiment of FIG. 6*a* has the additional advantages of being highly compact and less expensive to manufacture, since the tilter and tilt angle selector are formed as one unit.

Figure 6B:
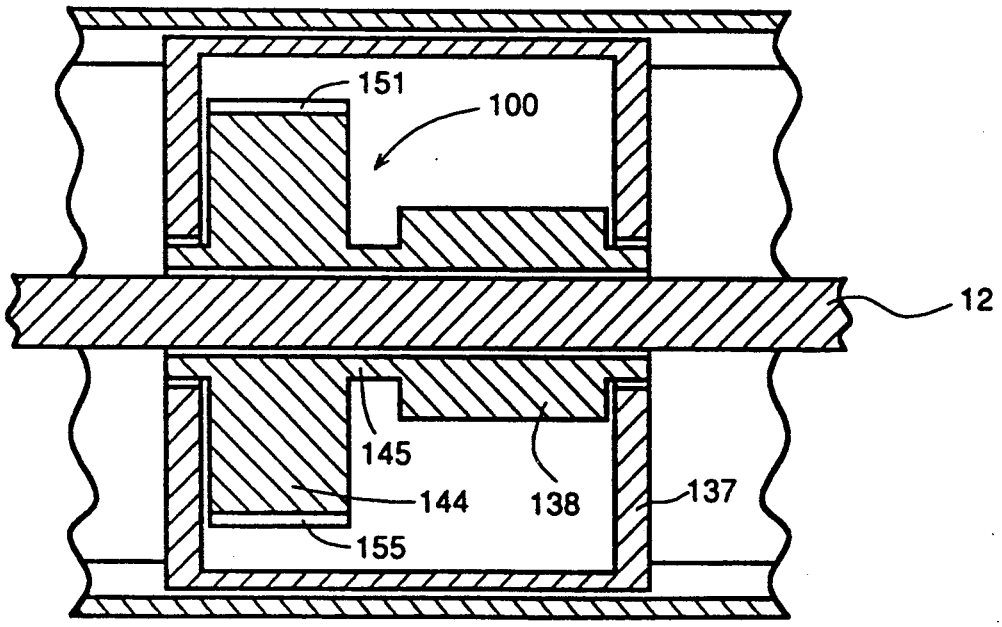

Referring to FIG. 6*b*, another embodiment of a tilt angle selector is shown that, like the embodiment of FIG. 6A, features an integrated unit 100 that includes a detent cam 144 and an idler gear 138 connected by drive section 145. In the embodiment of FIG. 6*b*, however, a housing 137 surrounds the entire unit 100.

Figure 7:
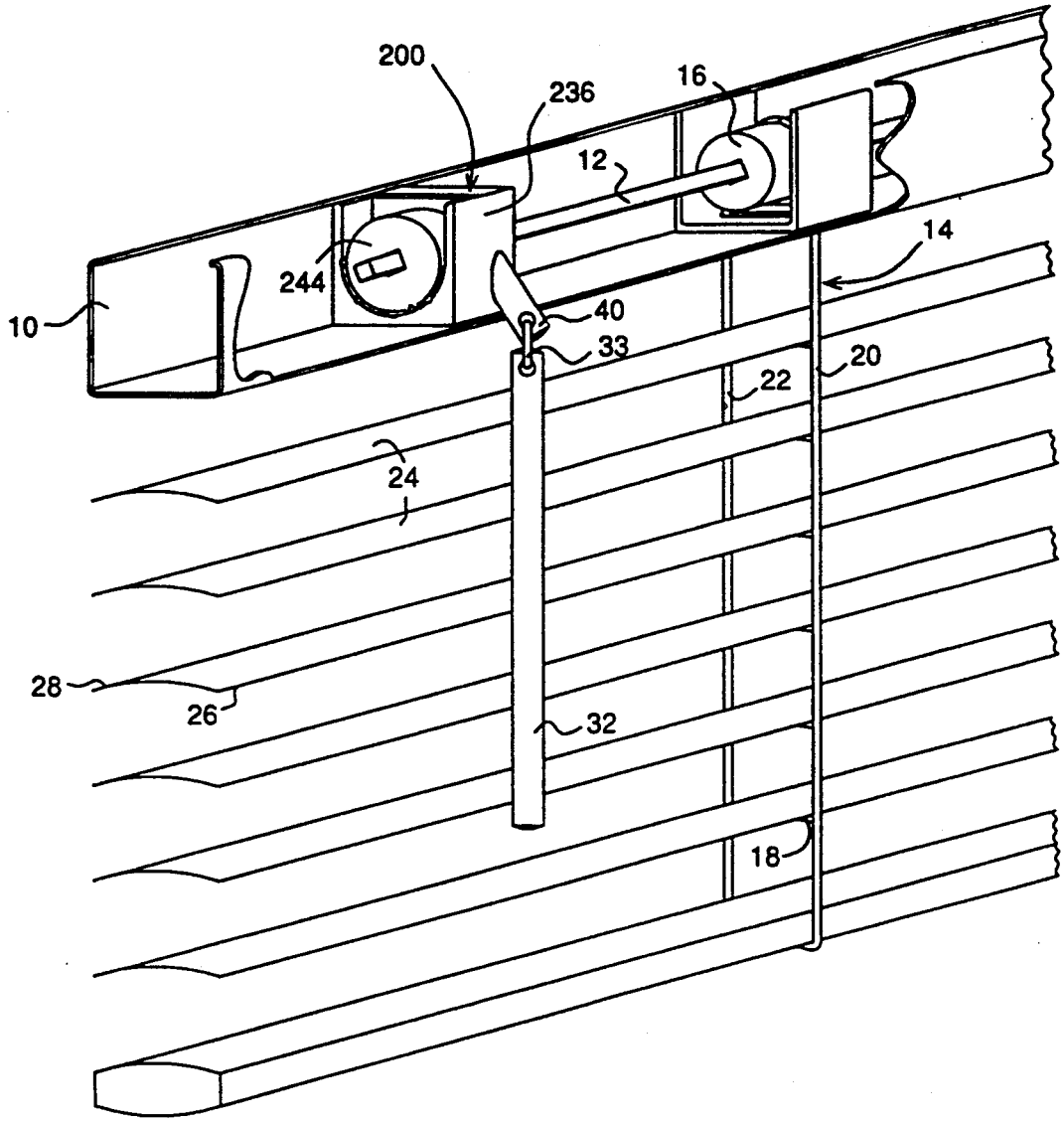
FIG. 7 is a sectional perspective view of a venetian blind according to another embodiment of the invention.

Another embodiment of the invention is shown in FIG. 7 and features an integrated unit 200 positioned in head rail 10. Unit 200 includes both a tilt angle selector and a tilter. A housing 236 partially encloses a cam 244 which surrounds tilt rod 12. Cam 244 is integrally formed with an idler gear (not shown) in a manner similar to the integrated cam 144 and idler gear 138 shown in FIGS. 6*a* and 6*b*. The remaining components of the venetian blind of FIG. 7 are similar to the components shown in FIG. 1 and are therefore not described in further detail here.

Figure 8:
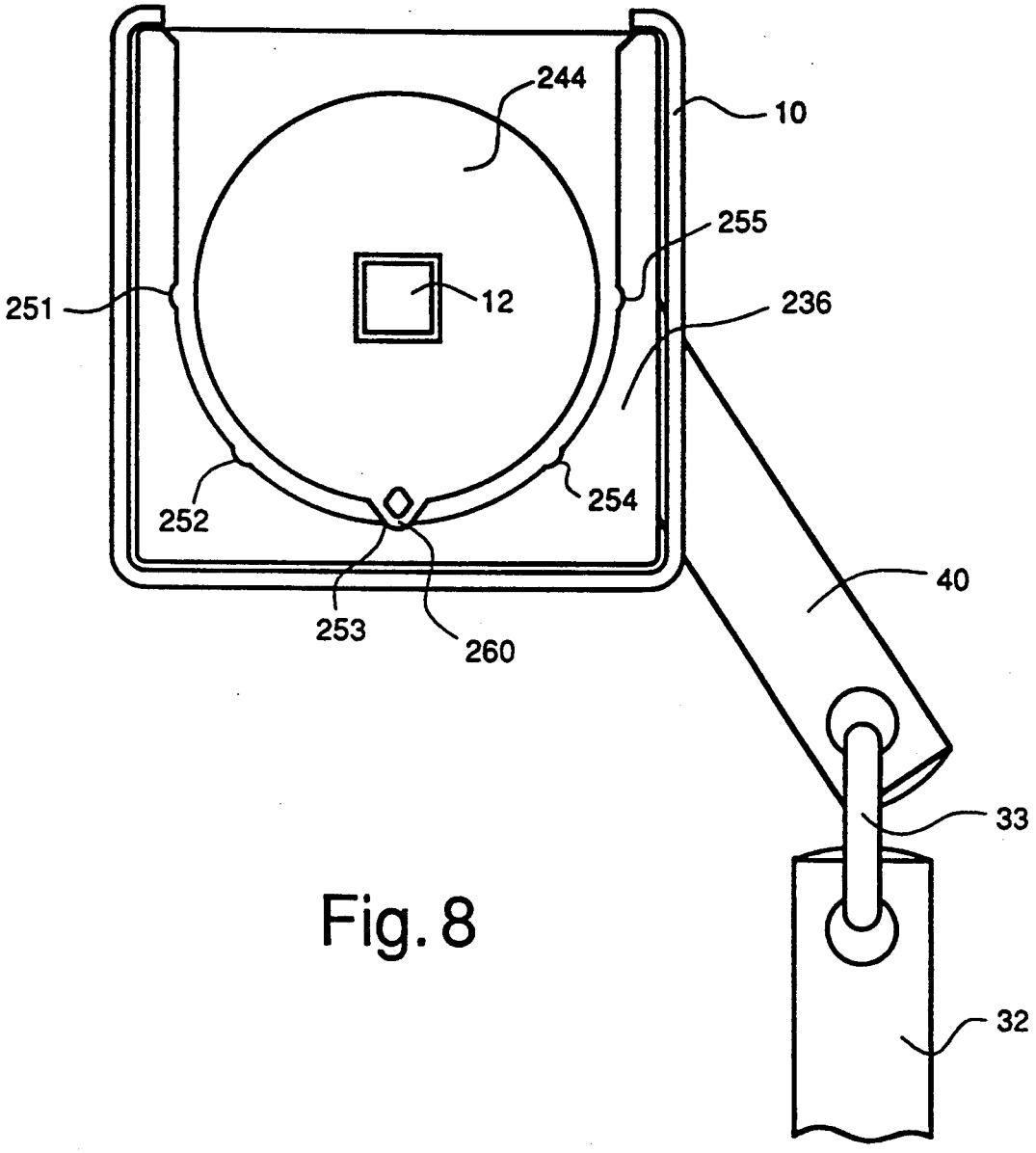
FIG. 8 is a cross-sectional end view of a tilt angle selector shown in FIG. 7.

Integrated unit 200 is shown in more detail in FIG. 8, and includes a flexible protrusion 260 located on the perimeter of cam 244. Housing 236 includes a 180° annular portion that has five detents 251-255 positioned at evenly spaced locations.

Figure 9:
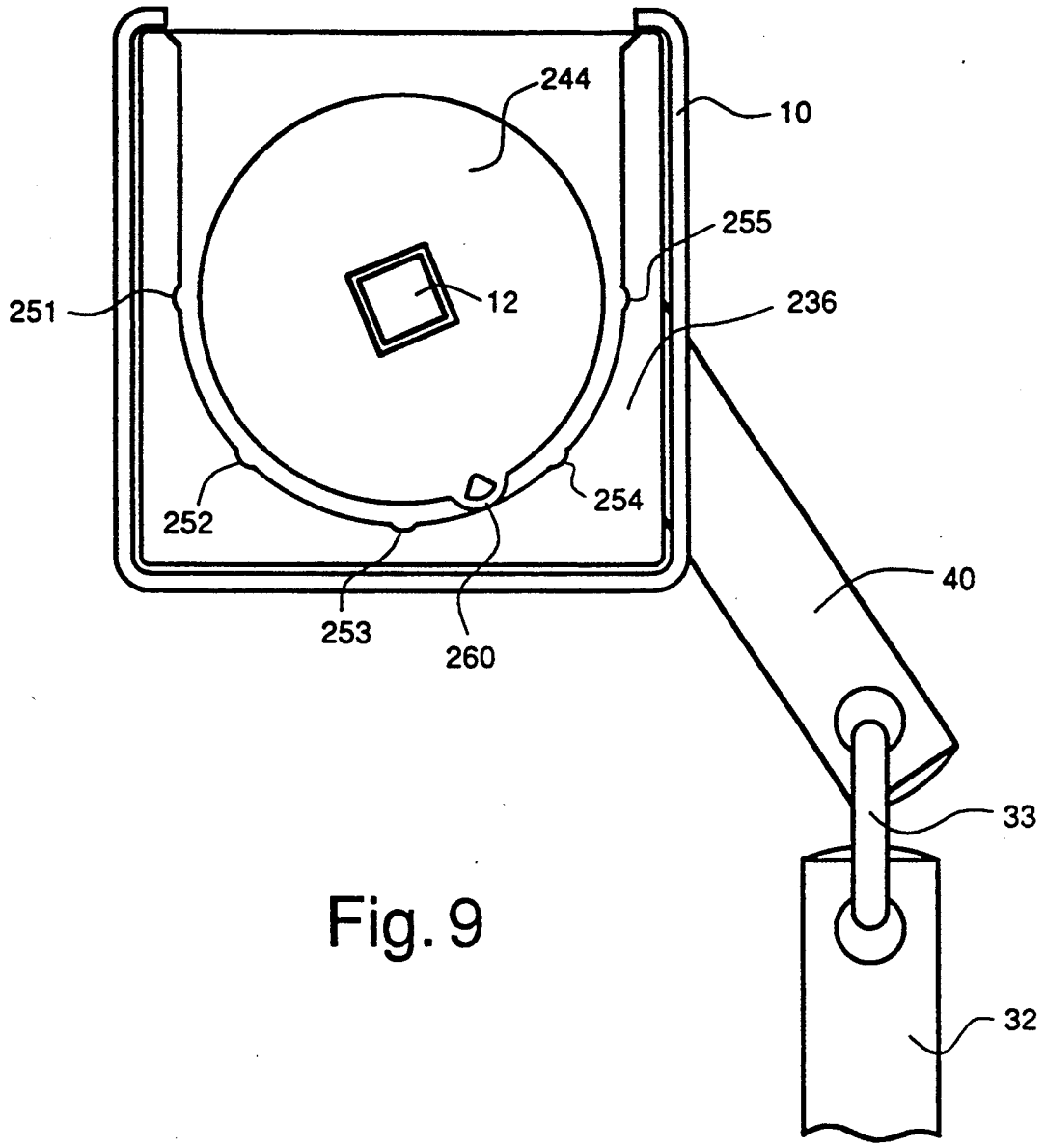
FIG. 9 is a second cross-sectional end view of the tilt angle selector shown in FIG. 7.

In operation, when a user of the venetian blind of FIGS. 7-8 rotates wand 32 to change the orientation of slats 24, worm gear 40 will rotate the idler gear 138 causing both tilt rod 12 and cam 244 to rotate. As cam 244 rotates protrusion 260 will travel along the annular portion of housing 236. Protrusion 260 will become engaged with one of detents 251-255 when cam 244 rotates to align protrusion 260 with a detent. FIG. 8 shows protrusion 260 engaged with detent 253 and FIG. 9 shows protrusion 260 at a position between detents 253 and 254.

Like the embodiment of FIGS. 1-5 discussed above, the positions of detents 251-255 are selected such that slats 24 are at a predetermined desired setting when protrusion 260 is engaged with a detent. Therefore, a user of the venetian blind shown in FIGS. 7-9 will be able to quickly set the slats at the five predetermined settings represented by the five detents 251-255.

Figure 10:
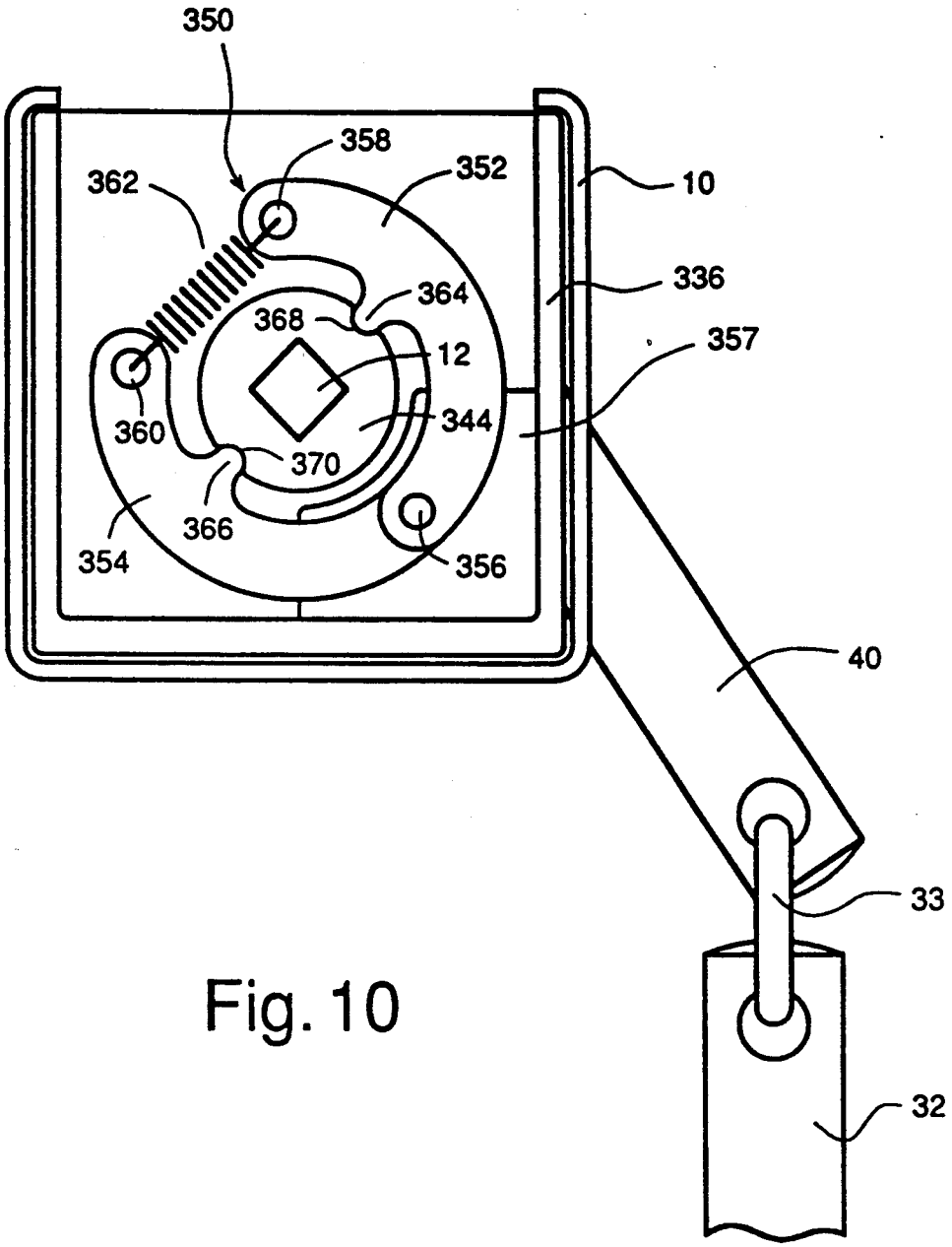
FIG. 10 is a cross-sectional end view of a tilt angle selector according to another embodiment of the invention.

Another embodiment of a tilt angle selector is shown in FIG. 10 and includes a detent cam 344 that surrounds tilt rod 12 and will rotate as tilt rod 12 rotates. A spring tensioned pincher 350 surrounds detent cam 344 and includes upper arm 352 and lower arm 354. The arms 352, 354 are connected at one end by a pin 356 that is anchored in a projection 357 of housing 336 such that each arm 352, 354 may pivot at pin 356. Arms 352, 354 each include a hole 358, 360, respectively, and a spring 362 is connected between holes 358, 360 so as to apply a biasing force that biases each of arms 352, 354 toward detent cam 344. Each arm 352, 354 also includes a projection 364, 366, respectively, that will contact cam 344 due to the biasing force of spring 362. Cam 344 includes detents 368 and 370.

As a user adjusts the slats in a blind featuring the tilt angle selector of FIG. 10, tilt rod 12 rotates causing detent cam 344 to rotate. Spring tensioned pincher 350 will not rotate with detent cam 344 and, due to the tension of spring 362, projections 364, 366 will travel along the periphery of detent cam 344 until the projections engage detents 368, 370. Therefore, like the embodiment of FIGS. 1-5, the device illustrated in FIG. 10 will impede the rotation of tilt rod 12 when a detent is engaged, causing the user to feel that a predetermined setting has been achieved. Although only two detents are shown in FIG. 10, any desired number of detents can be chosen corresponding to the desired number of slat settings.

Figure 11:
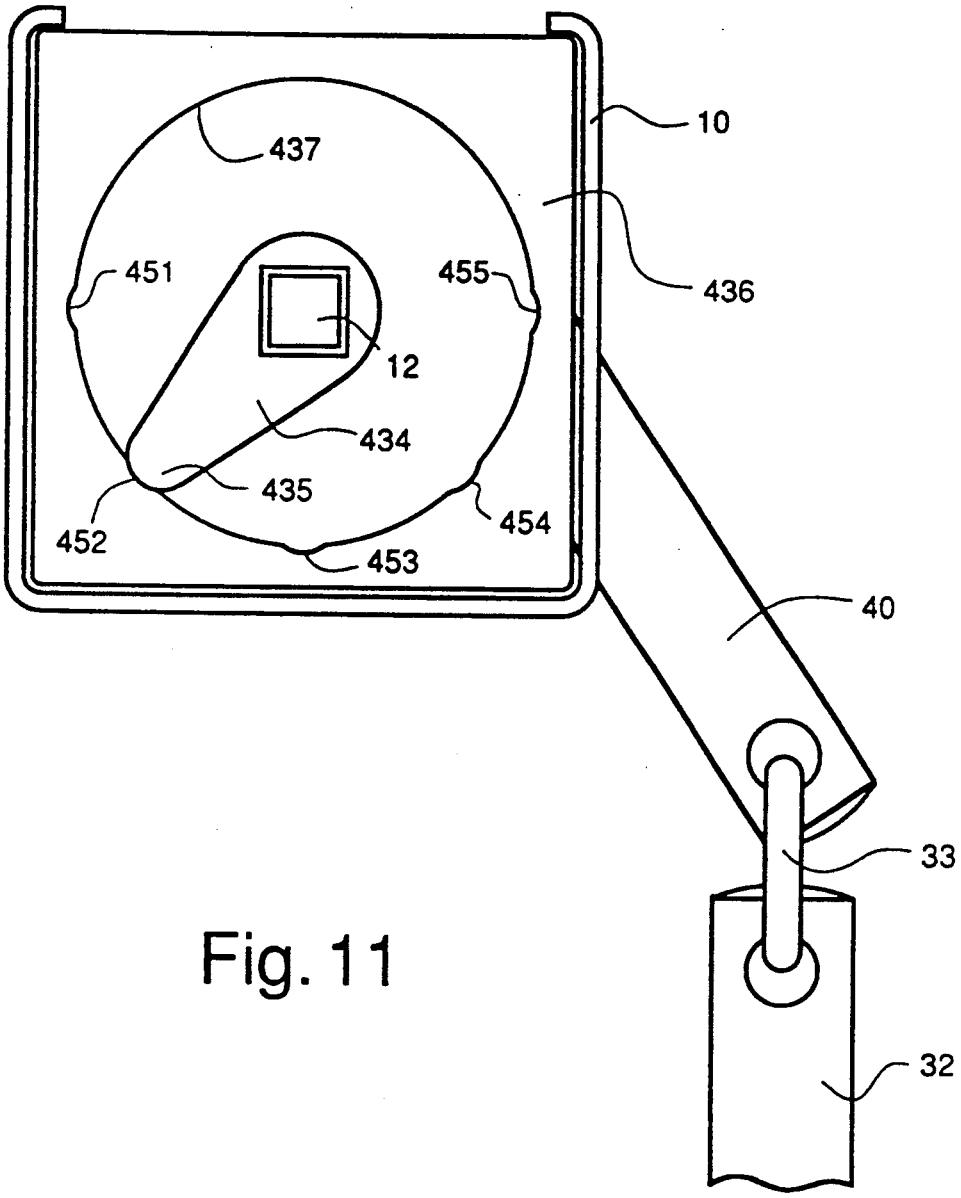
FIG. 11 is a cross-sectional end view of a tilt angle selector according to another embodiment of the invention.

Another embodiment of a tilt angle selector is shown in FIG. 11 and features a cam that comprises a flexible finger 434 which surrounds tilt rod 12 and rotates as tilt rod 12 rotates. A housing 436 sits within head rail 10 and has an annular inner surface 437 that includes detents 451-455. Tip 435 of finger 434 contacts surface 437.

In operation, as tilt rod 12 rotates finger 434 will rotate and tip 435 will travel along annular inner surface 437 of housing 436. When tip 435 becomes aligned with one of detents 451-455, it will engage the detent. As with other embodiments of the invention described above, the position of detents 451-455 correspond to desired settings of the slats.

The above description of the preferred embodiments are illustrative only and various modifications may be made within the scope of this invention, as described by the appended claims.

We claim:

1. A Venetian blind having slats, comprising;

a head rail, a rotatable tilt rod within said head rail for rotation of the slats, a ladder suspended from said tilt rod for supporting the slats and for tilting the slats to different slat angles as said tilt rod is rotated, a tilter within said head rail having a gear mechanism operatively connected to said tilt rod for rotation thereof by a user to cause said slats to rotate from a first closed tilted setting through a number of indeterminate opened tilted settings to a second closed tilted setting, and a tilt angle selector operatively connected to said rod for releasably setting the angle of the slats at a plurality of predetermined precise settings independent of the settings of said tilter, including at least one open predetermined setting, upon rotation of said tilt rod by said tilter, wherein said tilt angle selector includes:

a pair of members, wherein one of said members is operatively connected to and rotates with said tilt rod and relative to the other of said members, and wherein one of said members has a plurality of spaced apart detents corresponding to the predetermined precise settings of the slats and being separated by smooth, continuous surfaces therebetween and the other of said members has engaging means thereon for releasably engaging said detents when a user rotates said tilt rod, to thereby indicate to the user that the slats are at a predetermined precise setting or for engaging one of said smooth, continuous surfaces, thereby providing infinite points of adjustment;

wherein said members of said tilt angle selector comprise:

a cam having a substantially angular perimeter that includes said plurality of detents at locations corresponding to said predetermined precise settings and said smooth, continuous surfaces therebetween, said cam rotating as said tilt rod is rotated; and a projection for engaging said detents, said projection being biased toward said perimeter of said cam such that said projection travels along said perimeter when said cam is rotated and releasably engages one of said detents when said projection becomes aligned with a detent;

wherein said projection comprises a spring clip.

2. The Venetian blind of claim 1, wherein one of said members has five spaced apart detents representing the closed positions of the slats, the fully open perpendicular position of the slats and the 45° positions of said slats between a closed position and the fully open position.

3. The Venetian blind of claim 1 or claim 2, further comprising a plurality of the Venetian blinds in proximity of one another.

4. The Venetian blind of claim 1, wherein the interaction of said members of said tilt angle selector provides a visual indication to the user when the slats are at a predetermined precise setting.

5. The Venetian blind of claim 1, further comprising a housing within said head rail for holding said spring clip.

6. The Venetian blind of claim 1, wherein said biased projection causes the slats to jump as said projection is fully engaged by a detent, to thereby provide a visual indication to the user that the slats are at a predetermined precise setting.

7. The Venetian blind of claim 1, wherein said gear mechanism of said tilter for rotating said tilt rod comprises;

a first gear on said tilt rod to cause rotation thereof when aid first gear is rotated;

a second gear intermeshing with said first gear to cause rotation of said first gear when said second gear is rotated; and means connected to said second gear for rotation of said second gear, to thereby cause rotation of said tilt rod.

8. The Venetian blind of claim 7, wherein said first gear is integral with said cam.

9. The Venetian blind of claim 7, wherein said means for rotating said second gear is a wand.

10. The Venetian blind of claim 7, wherein said first gear is an idler gear and said second gear is a worm gear.

11. In a Venetian blind having slats, a head rail, a rotatable tilt rod within the head rail for rotation of the slats, a ladder suspended from the tilt rod for supporting the slats and for tilting the slats to different slat angles as the tilt rod is rotated, and a tilter within the head rail having a gear mechanism connected to the tilt rod for rotation thereof by a user to cause the slats to rotate from a first closed tilted setting through a number of indeterminate opened tilted settings to a second closed tilted setting, the improvement comprising:

a tilt angle selector for releasably setting the angle of the slats at a plurality of predetermined precise settings independent of the tilter, including at least one open predetermined precise setting, upon rotation of the tilt rod by the tilter, wherein the tilt angle selector includes:

a pair of members, wherein one of said member is adapted to be operatively connected to and rotate with the tilt rod and relative to the other of said members, and wherein one of said members has a plurality of spaced apart detents corresponding to the predetermined precise settings of the slats and being separated by smooth, continuous surfaces therebetween and the other of said members has engaging means thereon for releasably engaging said detents when a user rotates the tilt rod, to thereby indicate to the user that the slats are at a predetermined precise setting or for engaging one of said smooth, continuous surfaces, thereby providing infinite points of adjustment, wherein said members of said tilt angle selector comprise: a cam having a substantially annular perimeter that includes said plurality of detents at locations corresponding to said predetermined precise settings and said smooth, continuous surfaces therebetween, said cam rotating as said tilt rod is rotated, and a projection for engaging said detents, said projection being biased toward said perimeter of said cam such that said projection travels along said perimeter when said cam is rotated and releasably engages one of said detents when said projection becomes aligned with a detent;

wherein said projection comprises a spring clip.

12. The Venetian blind of claim 11, wherein one of said members has five spaced apart detents representing the closed positions of the slats, the fully open perpendicular position of the slats and the 45° positions of the slats between a closed position and the fully open position.

13. The Venetian blind of claims 11 or 12, further comprising a plurality of the Venetian blinds in proximity of one another.

* * * * *